United States Patent [19]

Matsubara

[11] Patent Number: 4,645,698

[45] Date of Patent: Feb. 24, 1987

[54] DEHYDRATING AND WATER-RETAINING SHEET

[75] Inventor: Mamoru Matsubara, Yokohama, Japan

[73] Assignee: Showa Denko Kabushiki Kaisha, Tokyo, Japan

[21] Appl. No.: 732,208

[22] Filed: May 9, 1985

[30] Foreign Application Priority Data

May 9, 1984 [JP] Japan ..... 59-90893

[51] Int. Cl.[4] ..... B32B 1/06; B65B 55/00; B65D 81/26; B65D 85/00

[52] U.S. Cl. ..... 428/68; 34/9; 34/95; 34/DIG. 1; 99/467; 128/132 D; 206/204; 426/112; 426/124; 426/465; 428/74; 428/76; 428/286; 428/311.1; 428/311.7; 428/318.4; 428/319.3; 428/913; 604/365; 604/368; 604/372; 604/376; 604/378

[58] Field of Search ..... 34/9, 95, DIG. 1; 426/112, 124, 465; 99/467; 428/68, 74, 76, 286, 311.1, 311.7, 318.4, 319.3, 913; 604/365, 368, 372, 376, 378

[56] References Cited

U.S. PATENT DOCUMENTS 4,383,376 5/1983 Numamoto et al. .

FOREIGN PATENT DOCUMENTS 21203 2/1980 Japan .
75054 6/1981 Japan .
122914 7/1982 Japan .
167734 10/1982 Japan .
107133 6/1983 Japan .

*Primary Examiner*—James C. Cannon
*Attorney, Agent, or Firm*—Sughrue, Mion, Zinn, Macpeak, and Seas

[57] ABSTRACT

A dehydrating and water-retaining sheet comprising a water-absorbing agent, a wetting agent having a water-absorbing property, and a water-permeable membrane, in which the water-absorbing agent and the wetting agent are at least partially wrapped together in the water-permeable membrane.

6 Claims, No Drawings

DEHYDRATING AND WATER-RETAINING SHEET

BACKGROUND OF THE INVENTION (1) Field of the Invention

The present invention relates to a dehydrating and water-retaining sheet. More particularly, it relates to a multipurpose dehydrating and water-retaining sheet which can be used for various applications and can be used in a disposable way.

(2) Description of the Related Art

Processes whereby foods are dehydrated and dried to make them keepable have been known for many years. For example, keepable foods have been prepared by various methods, such as heating, vacuum treatment, solvent treatment, freeze-drying, preserving in salt, and preserving in sugar. Recently, keepable foods having an intermediate water content have been developed by the discovery of a contact dehydration method using a dehydrating sheet comprising a combination of a water-permeable sheet and a water-absorbing agent, and these kept foods have become popular.

This contact dehydration method is advantageous in that dried fish having a low salt content can be obtained because no salt is used, the propagation of bacteria can be prevented during the production process of the dried fish because the dehydration proceeds at a significant speed, no deterioration in the protein occurs because there is no application of heat, self-digestion due to enzymes is prevented, and the production of the dried foods does not require a large-scale apparatus.

However, the sheets for contact dehydration prepared hitherto have various defects and are not satisfactory for practical purposes.

For example, Japanese Unexamined Patent Publication (Kokai) No. 56-75054 discloses a dehydrating sheet comprising a combination of a semipermeable membrane such as a collodion membrane and a water-absorbing agent consisting of an organic compound. Furthermore, Japanese Unexamined Patent Publication (Kokai) No. 56-124404 discloses a dehydrating sheet comprising a combination of the above-mentioned semipermeable membrane and a high tension organic substance such as sucrose.

The semipermeable membrane is however disadvantageous in that the bonding strength is low and the tensile strength is remarkably variable depending upon the water content.

Japanese Unexamined Patent Publication (Kokai) Nos. 55-21203, 57-122914, 57-167734 and 58-107133 disclose a combination of a water-permeable membrane, such as a heat-sealable unwoven fabric or a perforated film, and an absorbing agent. Also known is a dehydrating sheet comprising the above-mentioned combination and a substrate consisting of a water-absorbing agent (Japanese Unexamined Patent Publication (Kokai) No. 57-167734) or a dehydrating sheet with quilting applied to the entire surface thereof (Japanese Unexamined Patent Publication (Kokai) No. 55-21203). These dehydrating sheets are disadvantageous in that, because the water absorption occurs only by a capillarity between the water-absorbing agent particles through the water-permeable membrane, the rate of water absorption is slow, and further, because the water absorption occurs only at portions of the dehydrating sheet in contact with the object to be dehydrated, the water absorbing agent undergoes an uneven and partial expansion which hinders the attainment of the desired object.

In view of these facts, a combination of a high tension liquid such as highly condensed sucrose and thick melt syrup and a polymeric water-absorbing agent is known from Japanese Examined Patent Publication (Kokoku) No. 58-58124. In accordance with this dehydrating sheet, which is prepared by applying the high tension liquid on the water permeable membrane, the defect of the partial contact of the above-mentioned prior art is improved and the contact area becomes large, with the result that the dehydration of goods can be efficiently carried out. However, this dehydrating sheet is disadvantageous in that, because of the high cost involved, it should be able to be reused. However, this means that the used sheet should be dried before reuse, and thus sanitary problems arise, especially when it is used for dehydrating foods, and therefore, various limitations are imposed when it is to be reused.

A combination of a water-absorbing polymer substance and hydrophilic adhesive substance in which the water-absorbing polymer substance is dispersed in the hydrophilic adhesive substance is known from U.S. Pat. No. 4,383,376. This dehydrating sheet, however, absorbs liquid water but does not absorb gaseous water.

With this structure of the above-mentioned dehydrating means, it is considered that a stage in which water is absorbed in the water-absorbing agent due to capillarity at a stage in which water is absorbed in the high tension liquid due to a difference in osmotic pressure determines the rate of dehydration.

SUMMARY OF THE INVENTION

In view of the above, the present inventors obtained a water absorbing sheet having a water absorption mechanism quite different from that of the above-mentioned conventional dehydrating sheets. Thus, the present invention was accomplished.

The present invention provides a dehydrating and water-retaining sheet comprising a water-absorbing agent, a wetting agent having a water-absorbing property, and a water-permeable membrane, in which the water-absorbing agent and the wetting agent are wrapped together in the water-permeable membrane.

In the dehydrating and water-retaining sheet according to the present invention, the wetting agent desirably may be supported by a water-permeable material and the water-absorbing agent may preferably form a hydrous gel when placed in contact with water.

DESCRIPTION OF THE PREFERRED EMBODIMENTS

Preferably, the dehydrating and water-retaining sheet of the present invention is prepared by forming a water-absorbing portion comprising a water-absorbing agent, preferably a polymeric material capable of forming a hydrous gel upon contact with water and a wetting agent having a chemical property of absorbing moisture from the air or other objects, and wrapping the water-absorbing portion with a water-permeable heat-sealable membrane in such a manner that it is formed into a sheet.

Where the thus-formed dehydrating and water-retaining sheet of the present invention is used as a water-absorbing sheet, the hygroscopic wetting agent positively absorbs moisture from the goods in contact with the sheet through the water-permeable diaphragm and the absorbed moisture is in turn absorbed in the polymeric material capable of forming a hydrous gel, with the result that a high rate of dehydration is attained. Furthermore, the wetting agent may be allowed to be absorbed in a medium such as paper or a nonwoven fabric and the polymeric material may be spread in the form of a thin layer on the medium to form a water-absorbing portion. Then, the water-absorbing portion is wrapped in a heat-sealable water-permeable film. The resultant dehydrating sheet is very convenient to handle. Furthermore, the dehydrating sheet has a large area with which the goods to be dehydrated are brought into contact and absorbs moisture from the goods through the entire surface of the sheet. Therefore, the dehydrating sheet can exhibit an excellent dehydrating ability.

When this sheet is used, the goods to be dehydrated are placed on the wetting agent side surface of the sheet, or are sandwiched between the wetting agent side surfaces of the two sheets. In this case, if necessary, a load may be applied to the composite to attain a closer contact between the sheet and the goods, thereby promoting the dehydration.

Where the dehydrating and water-retaining sheet of the present invention is used as a water-retaining sheet, the sheet may be used directly or in the hydrous state for the desired applications.

The thus-formed dehydrating and water-retaining sheet of the present invention is used for sanitary supplies such as a diaper and sanitary belt or napkin; medical supplies such as an operating table pad, a bed pad, and a bedsore-preventing pad; food applications such as the production of dried fish, dry provisions, and low temperature half dried fish, a sheet for preventing dripping during the thawing of frozen foods, and a contact type dehydrating sheet for the frozen storage of perishable foods; and industrial applications such as water removal from organic solvents, a carrier for fixed enzymes, and a substrate for an aquafilter. Furthermore, because of its high water-retaining ability, the sheet of the present invention may also be used as a hydrous sheet for fire prevention and fire extinguishing, a coating fabric for seed coating and seedling rooting, and soil conditioning. In addition, it may be used for hardening sludge or waste from a cattle shed.

The polymeric material capable of forming a hydrous gel which is usable for the present invention may be any such material conventionally used for a dehydrating sheet. For example, the polymeric materials capable of forming a hydrous gel can be those commercially used at present in the fields of sanitary supplies, diapers, soil conditioning agents and the like. As such a polymeric material, there are known, for example, tridimensional polymers prepared by graft polymerizing a polymerizable monomer which is water-soluble or becomes water-soluble on hydrolysis, such as acrylic acid, methacrylic acid, acrylic acid salts, methacrylic acid salts, acrylic esters, methacrylic esters, acrylic amide, methacrylic amide, acrylonitrile, methacrylonitrile, maleic acid, sulforated styrene, and polyvinyl pyridine and oligomers or cooligomers thereof, with a polysaccharide such as starch and cellulose, by optionally hydrolyzing the resultant polymer and by cross-linking the hydrophilic polymer in the presence of a crosslinking agent, and another type of tridimensional polymers prepared by crosslinking a hydrophilic polymer, such as polyethylene oxide, polypropylene oxide, polyvinyl pyrrolidone, sulfonated polystyrene, polyvinyl pyridine, polyacrylic acid salts, polyacrylic amide, polymethacrylic acid salts, and polymethacrylic amide, in the presence of a crosslinking agent. As the commercially available products, there are, for example, known PX-402A manufactured by Showa Denko Kabushiki Kaisha, SUN WET IM-300 manufactured by Sanyo Kasei Kogyo Kabushiki Kaisha, and AQUAKEEP 10SH manufactured by Seitetsu Kagaku Kogyo Kabushiki Kaisha. As the above-mentioned crosslinking agent, there may be mentioned, for example, di- or tri-(metha)acrylic esters of polyols such as ethylene glycol, trimethylolpropane, glycerin, polyoxyethylene glycol, and polyoxypropylene glycol; unsaturated polyesters obtained from the reaction of the above-mentioned polyols with unsaturated acids such as maleic acid; bisacrylic amides such as N,N-methylenebisacrylic amide di- or tri-(metha)acrylic esters obtained from the reaction of polyepoxides with (metha)acrylic acid; di-(metha)acrylic acid carbamyl esters obtained from the reaction of polyisocyanates such as tolylene diisocyanate and hexamethylene disocyanate with hydroxyethyl (metha)acrylate; allylated starch; and allylated cellulose. In some instance, bifunctional compounds capable of serving as a cross-linking agent under certain reaction conditions, such as methylolated (metha)acrylic amide, glyoxal, phthalic acid, adipic acid and ethylene glycol, calcium oxide, and polyvalent metal salts, such as zinc acetate, also may be used.

The wetting agents usable for the present invention include, for example, polyhydric alcohols such as ethylene glycol, propylene glycol, polypropylene glycol, polyethylene glycol, diethylene glycol monoethyl ether, 1,3-butylene glycol, glycerin, and polyglycerin, and hygroscopic polymeric materials such as methyl cellulose, sodium carboxymethyl cellose, xylitol, sorbitol, and maltitol. These wetting agents may be used singly or in any mixture thereof. These wetting agents are used in a liquid state. The wetting agent may be supported by a water-permeable material, if desired. Such water-permeable materials may include paper, pulp sheet, woven or knitted fabric, non-woven fabric and the like.

The water-permeable membrane usable for the present invention includes paper, pulp sheet, woven or knitted fabric, non-woven fabric, perforated plastic sheet, and the like. Preferably, the water-permeable membrane may be heat-sealable. The heat-sealable water-permeable membrane may be made by using a non-woven fabric of satisfactorily fine mesh made of thermoplastic material, by subjecting a water-impermeable thermoplastic film to electron beam irradiation to form pores communicating with each other throughout the entire thickness of the film, by using a thermoplastic film which has been subjected to a foaming procedure in which formation of fine pores communicating with each other takes place, or by adding inorganic or high melting nucleators to a sheet-providing material and subjecting the mixture to a drawing process to cause pores communicating with each other to be generated in the resultant sheet. These sheet materials are generally used at present as a separator for a dry battery or as a special filter fabric. In accordance with the present invention, a heat-sealable water-permeable membrane is selected as the membrane material because when a hygroscopic polymer becomes a hydrous gel, the diameter of the gel particle in several tens times that of the original polymer particle and, hence, a semipermeable membrane having fine pores of the order of millimicrons is not necessary, and because the longer the pore diameter, the higher the water permeability. The water-permeable membrane is difficult to bond effectively and, hence, the bonded portions have no satisfactory water resistance. This is because when the water-permeable film is brought into contact with water, the water penetrates into the bonded surfaces. In accordance with the present invention, since the water-permeable sheet is integrally bonded to the substrate by heat sealing, the water resistance of the bonded portions is remarkably improved. Furthermore, a shorter period of time is necessary for heat sealing than for adhesive bonding because the heat-sealed portions become hardened at a temperature lower than the melting point of the sheet. In addition, as compared with an adhesive bonding method, a larger number of processing machines for heat fusion are on the market, and hence, existing processing machines can be utilized. This also is a great advantage of this invention.

The present invention is a dehydrating means comprising a water-permeable membrane made of a heat-sealable material and having pores of a much larger diameter than that of the conventional semipermeable membrane. It is no exaggeration to say that the practical use of the contact dehydration of foods or the like has gained a footing because of the present invention. Where a dehydrating sheet is used for foods or the like, any substance which may come into contact with the foods when the sheet is torn, to say nothing of a material which comes into direct contact with the foods, must be safe when it is mixed with the foods. When a material capable of being easily torn or an adhesive bonding method is used, no matter how high the water-absorbing ability of the material used may be, the resultant dehydrate sheet has a fatal defect which remarkably hinders the practical use thereof.

As the membrane, the use of a non-woven fabric of significantly rough mesh may be considered. However, the degree of roughness of the non-woven fabric should not be such that the water-absorbing polymer itself in the dry or anhydrous state passes through through the meshes of the fabric. Therefore, there is a spontaneous limitation to the degree of roughness of the fabric. It is preferable that the degree of bulkiness (thickness) of the non-woven fabric be limited from the viewpoint of heat sealability.

The dehydrating means of the present invention need not have a water-permeable membrane over the entire surface thereof. Only a portion of the dehydrating means to be brought into contact with water may be composed of a water-permeable membrane. Practically, portions of the dehydrating means not coming into contact with the object to be dehydrated may be composed of a water-impermeable film such as a conventional polyolefin film, without hindrance. This makes it possible to reduce the proportion of the heat-sealable water-permeable film, which is more expensive than the conventional film.

Furthermore, in accordance with the present invention, pulp and inorganic fillers which are incapable of penetrating through the water-permeable membrane may be used together with the hydrous gel-forming material without impairing the action, principle, and function of the hydrating means.

The amount of water-absorbing polymeric material to be sandwiched between sheet-like materials of the water-permeable membrane is determined depending upon a balance between the absorption capacity of the polymeric material and the absorption and retention capacity required in the sheet. The most appropriate amount of the polymeric material is determined depending upon the end use of the product and the use conditions.

The dehydrating and water-retaining sheet of the present invention can be further utilized as a humidity-controlling device. Moisture in atmosphere is absorbed by the dehydrating and water-retaining sheet or moisture absorbed is released from the sheet into atmosphere to equilibrate the moisture in the atmospheric system to a certain level. Thus, the dehydrating and water-retaining sheet of the present invention may be used for forming a humidity or moisture-controlling vessel by placing the sheet in a closed vessel. Such a humidity or moisture-controlling vessel can be advantageously used for controlling the moisture content of foods contained in the vessel.

The present invention will be further illustrated below by way of non-limitative examples.

EXAMPLE 1

0.4 g of a polyacrylic acid type polymeric water-absorbing agent (PX-402A, manufactured by Showa Denko Kabushiki Kaisha) was spread on a piece of paper 10 cm square (trade name: KLEENEX TOWEL, manufactured by Jujo Kimberley Kabushiki Kaisha). Paper impregnated with 1 g of propylene glycol (trade name: KLEENEX TOWEL, Jujo Kimberley Kabushiki Kaisha) was superimposed on the water-absorbing agent-spread surface of the above-mentioned paper. Ten pieces of this laminate sheet were prepared.

A half cut of commercially available devil's-tongue jelly (4.0 cm×7.0 cm×1.0 to 1.5 cm) was sandwiched between two pieces of the laminate sheet, and a 650 g weight was placed on the sandwich. Then, the reduction in the weight of the devil's-tongue jelly was determined. The results concerning 5 sets were averaged, and the following results were obtained.

| Time (hour) | Reduction in Weight |
|---|---|
| 1 | 16% |
| 2 | 23% |
| 3 | 28% |
| 4 | 32% |
| 5 | 35% |
| 6 | 38% |

On the other hand, 10 pieces of laminate sheet were prepared according to the same procedure as mentioned above except that one of the pieces of paper used was not impregnated with propylene glycol. The same piece of devil's-tongue jelly was used to determine the reduction in the weight thereof. The results indicating the average of the measurements for five sets were as follows.

| Time (hour) | Reduction in Weight |
|---|---|
| 1 | 12% |
| 2 | 17% |
| 3 | 21% |
| 4 | 23% |
| 5 | 26% |
| 6 | 28% |

EXAMPLE 2

0.4 g of a polyacrylic acid type polymeric water-absorbing agent (PX-402A, manufactured by Showa Denko Kabushiki Kaisha) was uniformly spread on a piece of paper 10 cm square (trade name: KLEENEX TOWEL, manufactured by Jujo Kimberley Kabushiki Kaisha). The water-absorbing agent-spread surface of the paper was superimposed with paper impregnated with 1 g of propylene glycol per 100 $cm^2$ of the paper (trade name: KLEENEX TOWEL, manufactured by Jujo Kimberley Kabushiki Kaisha) and then with a synthetic resin type non-woven fabric (trade name: SYNTEX, manufactured by Mitsui Sekiyu Kagaku Kogyo Kabushiki Kaisha). In this manner, ten pieces of this laminate sheet were prepared. Two pieces of this sheet were superimposed on each other with the non-woven fabric side surfaces facing each other. Five sets of such composite were obtained. A horse mackerel with the ventral side opened was inserted between the non-woven fabrics of each set to dehydrate the fish.

The results are as follows. The figures indicate the average of the measurements for five sets.

| Time (hour) | Reduction in Weight |
|---|---|
| 1 | 2.4% |
| 2 | 4.1% |
| 3 | 5.1% |
| 4 | 5.9% |
| 5 | 6.7% |
| 6 | 7.4% |
| 7 | 8.0% |
| 8 | 8.6% |

The reduction in the weight of the horse mackerel substantially corresponded to the increase in the weight of the sheet. Good dried fish was obtained.

EXAMPLE 3

Tests were carried out using the same materials and procedures as those described in Example 2 and under the same conditions as those described in Example 2 except that one of the pieces of paper used was impregnated with 1.3 g of glycerin in place of the propylene glycol. The results are as follows.

| Time (hour) | Reduction in Weight |
|---|---|
| 1 | 3.7% |
| 2 | 5.2% |
| 3 | 6.5% |
| 4 | 7.7% |
| 5 | 8.6% |
| 6 | 9.5% |
| 7 | 10.3% |
| 8 | 10.9% |

COMPARATIVE EXAMPLE 1

The reduction in the water content of a horse mackerel was determined by using the same amount of the water-absorbing agent as in Examples 2 and 3 but omitting the wetting agent. The other conditions were all identical with those described in Examples 2 and 3. The results are shown as follows.

| Time (hour) | Reduction in Weight |
|---|---|
| 1 | 1.6% |
| 2 | 2.5% |
| 3 | 3.2% |
| 4 | 3.7% |
| 5 | 4.0% |
| 6 | 4.2% |

-continued

| Time (hour) | Reduction in Weight |
|---|---|
| 7 | 4.4% |
| 8 | 4.5% |

EXAMPLE 4

0.4 g of a polyacrylic acid type water-absorbing agent (trade name: PX, manufactured by Showa Denko Kabushiki Kaisha) was spread on a piece of paper 10 cm square. Paper impregnated with 0.5 g of propylene glycol (trade name: KLEENEX TOWEL, manufactured by Jujo Kimberley Kabushiki Kaisha) was superimposed on the water-absorbing agent-spread surface of the paper. Then, a non-woven fabric of the same size (trade name: SYNTEX, manufactured by Mitsui Sekiyu Kagaku Kogyo Kabushiki Kaisha) was further superimposed on the second paper. The other surface of the resultant laminate was covered with a polypropylene film (trade name: PP INFLATION FILM, manufactured by Asahi Jushi Kogyo Kabushiki Kaisha) to obtain a sample sheet. 10 g of artificial urine (composition: $K_2SO_4$ 0.20%, $CaCl_2.2H_2O$ 0.085%, $MgSo_4$0.11%, NaCl 0.82%, urea 2.0%) was allowed to permeate the resultant sheet from the nonwoven fabric side.

The artificial urine was dispersed throughout the sheet, and the nonwoven fabric was in the dry state and did not feel wet. Even if pressure was applied to the sheet, no oozing of the artifical urine due to a counter-flow occurred.

COMPARATIVE EXAMPLE 2

The same test as that described in Example 4 was carried out under the same conditions as those described in Example 4 except that the propylene glycol was not added.

Uneven expansion occurred in the sheet because only portions of the paper permeated with the artificial urine swelled. When a pressure was applied to the swollen portions, the artificial urine immediately oozed from these portions.

EXAMPLE 5

2 g of a polyacrylic acid type water-absorbing agent (trade name: PX, manufactured by Showa Denko Kabushiki Kaisha) was spread on a piece of paper 23 cm square (trade name: KLEENEX TOWEL, manufactured by Jujo Kimberley Kabushiki Kaisha). The water-absorbing agent-spread surface of the paper was superimposed with a wetting agent-impregnated paper consisting of paper of the same size (trade name: KLEENEX TOWEL, manufactured by Jujo Kimberley Kabushiki Kaisha) coated with 5 g of glycerin. The upper surface of the resultant laminate was covered with a water-permeable nonwoven fabric (trade name: SYNTEX, manufactured by Mitsui Sekiyu Kagaku Kogyo Kabushiki Kaisha). Then, the lower surface of the laminate was covered with a polypropylene film (trade name: PP INFLATION FILM, manufactured by Asahi Jushi Kogyo Kabushiki Kaisha). Thereafter, the surroundings of the laminate were heat sealed to obtain a sample sheet. 10 pieces of this sheet were prepared.

A 150 g piece of frozen tuna was wrapped in one set of two pieces of the sheet from the upper and lower sides thereof and was thawed at a temperature of 5° C. for 16 hours.

The thawed tuna exhibited no discoloration due to drip immersion, had an elastic surface, and tasted good.

COMPARATIVE EXAMPLE 3

A 150 g piece of frozen tuna was double wrapped in two pieces of paper towel (trade name: KLEENEX TOWEL, manufactured by Jujo Kimbery Kabushiki Kaisha) from the upper and lower sides thereof, and was placed in a polyethylene bag. Then, the frozen tuna was thawed at a temperature of 5° C. for 16 hours.

The thawed tuna was immersed in the drip at the lower portion thereof and showed black discolorations. Furthermore, the thawed tuna had a high content of water on the surface thereof, was not in a good state, and tasted bad.

I claim:

1. A dehydrating and water-retaining sheet comprising (a) a water-absorbing agent comprising a polymeric material capable of forming a hydrous gel, (b) a wetting agent having a water-absorbing property, and (c) a water-permeable membrane, in which the water-absorbing agent (a) and the wetting agent (b) are at least partially wrapped in the water-permeable membrane (c).

2. A sheet as set forth in claim 1, wherein the wetting agent (b) is supported by a water-permeable material.

3. A sheet as set forth in claim 2, wherein the water-permeable material is selected from the group consisting of paper, pulp sheet, woven fabric, knitted fabric, and non-woven fabric.

4. A sheet as set forth in claim 1, wherein the polymeric material capable of forming a hydrous gel is a tridimensional cross-linked product of a hydrophilic polymer.

5. A sheet as set forth in claim 1, wherein the wetting agent (b) is selected from the group consisting of hydrophilic polyhydric alcohols and hygroscopic polymers.

6. A sheet is set forth in claim 1, wherein the water-permeable membrane (c) is selected from the group consisting of paper, pulp sheet, woven fabaric, knitted fabric, non-woven fabric, and perforated plastic sheet.

* * * * *